US008893779B2

(12) United States Patent
Treadaway et al.

(10) Patent No.: US 8,893,779 B2
(45) Date of Patent: Nov. 25, 2014

(54) RETRIEVABLE SLIP MECHANISM FOR DOWNHOLE TOOL

(75) Inventors: Shawn J. Treadaway, Houston, TX (US); Robert C. Stratton, Houston, TX (US); James A. Rochen, Waller, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 630 days.

(21) Appl. No.: 12/838,724

(22) Filed: Jul. 19, 2010

(65) Prior Publication Data

US 2012/0012306 A1 Jan. 19, 2012

(51) Int. Cl.
*E21B 33/129* (2006.01)
*E21B 23/01* (2006.01)

(52) U.S. Cl.
CPC ..... *E21B 33/129* (2013.01)
USPC ..... 166/216; 166/217; 166/138; 166/134; 166/118

(58) Field of Classification Search
CPC ..... E21B 23/00; E21B 23/01; E21B 33/12; E21B 33/1208; E21B 33/129; E21B 23/06; E21B 33/1292
USPC ..... 166/216, 217, 138, 140, 210, 134, 382, 166/118
See application file for complete search history.

(56) References Cited

U.S. PATENT DOCUMENTS 2,404,692 A * 7/1946 Church ..... 166/131
3,291,220 A 12/1966 Mott
4,619,319 A * 10/1986 Ringgenberg ..... 166/55.1
4,664,188 A 5/1987 Zunkel et al.
4,750,559 A 6/1988 Greenlee et al.
4,765,404 A 8/1988 Bailey et al.
4,921,045 A 5/1990 Richardson
4,984,636 A 1/1991 Bailey et al.

(Continued)

FOREIGN PATENT DOCUMENTS

GB 2150958 A 7/1985
GB 2343904 A 5/2000
GB 2402412 A 12/2004
WO 2007027228 A1 3/2007

OTHER PUBLICATIONS

Weatherford,"Ultra-Lok Packer," (C) 2005-2007, No. 2631.01, 3 pages.

(Continued)

*Primary Examiner* — Shane Bomar
*Assistant Examiner* — Wei Wang
(74) *Attorney, Agent, or Firm* — Wong, Cabello, Lutsch, Rutherford & Brucculeri, LLP

(57) ABSTRACT

A downhole tool slip mechanism including a cone, cage, and slip disposed on a mandrel. The cone and cage can be move in relation to one another, and the cone may be locked into place during run-in and retrieval downhole. The cage contains slip slots contains a spring retaining finger for a spring that resides between the retention finger and the slip. This spring serves to bias the slip inward during run-in and retrieval. The slip slots have load-bearing shoulders used to engage the slip during retrieval. The slips outer surface is completely covered in wickers so that the slip can sustain greater loads when set in place. Additionally, the slip has load-bearing shoulders with an increased thickness cross-section to sustain greater loads during retrieval while minimizing slip and cage failures.

21 Claims, 8 Drawing Sheets

(56) References Cited

U.S. PATENT DOCUMENTS

| | | | |
|---|---|---|---|
| 5,311,939 | A | 5/1994 | Pringle et al. |
| 5,701,954 | A | 12/1997 | Kilgore et al. |
| 6,119,774 | A | 9/2000 | Doane et al. |
| 6,241,017 | B1 | 6/2001 | Doane et al. |
| 6,378,606 | B1 | 4/2002 | Swor et al. |
| 6,478,093 | B1 | 11/2002 | Hilts et al. |
| 2004/0244966 | A1 | 12/2004 | Zimmerman et al. |

OTHER PUBLICATIONS

Weatherford, Hydrow I-SS Hydraulic Production Packer, (C) 2008, No. 2590.00, 2 pages.
Weatherford, "238CR-400CR Cement Retainer," (C) 2007, No. 2545.00, 2 pages.
Weatherford, " DLT Compression-Set Service Packer," (C) 2007, No. 2578.00, 2 pages.
Weatherford, "WRP Bridge Plug," (C) 2007, No. 2640.00, 3 pages.
Weatherford, "TS-U Retrievable Bridge Plug," (C) 2007, No. 2626.00, 2 pages.
Weatherford, "Stradaset II Compression-Set Packer," (C) 2008, No. 2621.00, 2 pages.
Weatherford, "32-A Tension-Set Packer," (C) 2007, No. 2547.00, 3 pages.
Weatherford, "ARM Selective-Treating Packer," (C) 2007, No. 2554.00, 2 pages.
Weatherford, "HRP Hydraulic Retrievable Production Packer," (C) 2007, No. 2589.00, 2 pages.
Weatherford, "PG Set-Down Packer," (C) 2008, No. 2607.00, 2 pages.
Weatherford, "HBP Hydro-Mechanical Bridge Plug," (C) 2007, No. 2583.00, 2 pages.
Weatherford, "Hydrow II-AP Hydraulic-Set, Dual-String Production Packer," (C) 2008, No. 2593.00, 4 pages.
Weatherford, "BA Tubing Anchor Catcher," (C) 2007, No. 2565.01, 2 pages.
Weatherford, "Hydrow II-A Hydraulic-Set, Dual-String Production Packer," (C) 2008, No. 2592.00, 3 pages.
Weatherford, "440 Casing Packer," (C) 2007, No. 2548.00, 3 pages.
Weatherford, "WH-6 Hydraulic Set Retrievable Packer," (C) 2005-2007, No. 2637.01, 2 pages.
Weatherford, "Hydrow I Hydraulic Production Packer," (C) 2008, No. 2591.00, 3 pages.
Weatherford, "PCR Cement Retainer," (C) 2007, No. 2605.00, 2 pages.
Weatherford, "ArrowTherm Mechanical-Set Thermal Packer," (C) 2007, No. 2561.00, 2 pages.
Weatherford, "HM-1 Bridge Plug," (C) 2007, No. 2586.00, 2 pages.
Weatherford, "HDL Compression-Set Packer," (C) 2008, No. 5662.00, 3 pages.
Weatherford, "Ultra-Pak™ TH Permanent Hydraulic-Set Packer," (C) 2002-2007, No. 4101.02, 2 pages.
Weatherford, "HD Compression-Set Retrievable Service Packer," (C) 2007, No. 2584.00, 2 pages.
Weatherford, "BlackCat™ TH CTR Production Packer," (C) 2009, No. 6528.01, 2 pages.
Weatherford, "UltraPak™ THH Permanent Packer," (C) 2009, No. 6529.01, 2 pages.
Examination Report received for corresponding Australian Patent Application No. 2011202435, dated Nov. 15, 2012.
Notice of Allowance received for corresponding Canadian Appl. 2,741,270, dated Mar. 22, 2013.
Second Examination Report received for corresponding Australian Appl. 2011202435, dated Nov. 6, 2013.

* cited by examiner

RETRIEVABLE SLIP MECHANISM FOR DOWNHOLE TOOL

BACKGROUND

Packers are used in oil and gas wells primarily to isolate different production zones. The packer is run downhole and set in place either hydraulically or mechanically, depending on the particular packer and the particular application. When the packer is in place, the annulus is blocked, and the production fluids are directed up the production tubing. On the packer, a slip mechanism provides a frictional hold between the packer and casing that helps keep the packer in place when subjected to high pressure and high thermal and applied forces.

Packers can be permanent or retrievable. Compared to a retrievable packer, a permanent packer is usually less expensive to manufacture and can be more resilient when set to high pressure and thermal and/or applied forces. Unfortunately, removing a permanent packer typically requires the packer to be milled out.

By contrast, a retrievable packer can be unset using a hydraulic or mechanical means, and the packer can then be pulled uphole with the production tubing or work string. Because the retrievable packer is designed to be removed, the retrievable packer is typically more complex and more expensive than a permanent packer. With this added complexity, the retrievable packer generally has more mechanical parts compared to a permanent packer, and this makes the retrievable packer more susceptible to mechanical failure upon or during retrieval. As expected, such mechanical failures can cause jams during retrieval, which can increase job times and expense.

Current slip mechanisms used in the art include T-style, hydro-style, and arrow-style slip mechanisms. When used on retrievable packers, these slip mechanisms have issues with both maximum load ratings and with retrieval problems after loading. Under higher loads, for example, the slip mechanisms can suffer mechanical failures, which results in difficulty retrieving the packer. Drilling operators seek to use slip mechanism in higher load applications and with fewer retrieval problems, but current slip mechanisms cannot meet these increasing requirements. Therefore, operators are limited by the maximum load ratings for current slip mechanisms.

FIGS. 1A-1B show a T-style slip mechanism 10 according to the prior art. The mechanism 10 includes T-style slips 20, a cone 30, and a cage 40—each of which dispose on a mandrel 14 of a retrievable packer 12 or the like. The T-style slips 20 have wickered ends 24 and T-shaped ends 28 interconnected by necks 22. Slip slots 42 in the cage 40 hold the T-shaped ends 28, while slots 32 in the cone 30 hold the wickered ends 24. In particular, the wickered ends 24 have shoulders or ledges 25 (FIG. 1B) that ride in grooves 35 in the cage's slots 32.

The T-style slips 20 set into the casing wall when the cone 30 is mechanically or hydraulically moved closer to the slip cage 40. For this reason, the slips' wickered ends 24 have ramped edges 27 that are pushed by the cone 30. Under load or during retrieval, the T-style slips 20 can suffer tensile failures, for example, near the shoulders 29 of the T-portion end 28 of the slip 20. Another type of failure common to the T-style slip mechanism 10 occurs when the forces at loading or retrieval (or a combination of the two) cause edges of the slip cage 40 and cage slot 42 to flair out.

Due to the failures that can occur, the T-style slip 20 can only have a certain width and amount of surface area that can set into the casing wall. For this reason, only the wickered end 24 of the slip 22 has wickers 26 to set into the case wall, while the T-shaped ends 28 have smooth surfaces. To increase their radial gripping area, the wickered end 24 could presumably be widened. Yet, any widening of the wickered end 24 would require the cone slip slots 32 to increase in size, and the neck 22 would be subjected to greater forces and have a higher likelihood of tensile failure.

To prevent flaring, wide portions 44 of the cage 40 may need to be present between each T-style slip 20 to main structural integrity of the mechanism 10. In the end, this limits the number of slips 20, the width of the slips 20, and the amount of wicker area 26 that can contact with the casing wall. To maintain the slip 20 in the retracted position during run-in and retrieval, the cone 30 and cage 40 stay in the un-set position during run-in or retrieval and keep the slip 20 from setting into the casing wall. Thus, the cage 40 must retain the T-portion end 28 of the slip 20, and the cone 30 must retain the wickered end 24 both during run-in and retrieval. The retention of the slip 20 in this way prevents the cone 30 from being locked into place in its retracted position during retrieval and puts the slips 20 held by the cone 30 and cage 40 under load.

FIGS. 2A-2B show a hydro-style slip mechanism 110 according to the prior art. The mechanism 110 includes hydro-style slips 120, a cone 130, and a cage 140—each of which dispose on a mandrel 14 of a retrievable packer 12 or the like. The hydro-style slips 120 fit around the mandrel 14 and have wickered faces 124*a-b* that fit through slip slots 142 in the cage 140. A spring 160 disposes in a central passage 122 along the length of the slip 120 and sits beneath a central band 144 in the slip slots 142. This spring, which is usually a leaf style spring, biases the slip 120 to a retracted condition when the cone 130 has been pulled out of the set position. As shown in the set position, however, the hydro-style slip 120 has wickers 126 on its outer face that can set into the surrounding casing wall (not shown).

To set the hydro-style slip 120 into the casing wall, the cone 130 is moved (typically by hydraulic activation) further beneath the slip cage 140 and also beneath the hydro-style slips 120. A ramped edge 137 on the cone 130 pushes against the ramped end 127 of the slip 120. Therefore, the cone 130 must slide beneath the slip cage 140 to push the slips 120 through the slip slots 142. This requires the thicknesses of the cone 130 and cage 140 to be appropriately configured, and this ultimately results in both the cone 130 and cage 140 being thinner due to space limitations.

For example, the cone 130 must be thick enough so that it does not collapse on the mandrel 14 under load, but it must be thin enough to slide under the slip cage 140. Likewise, the slip cage 140 must be thick enough to pluck the slips 122 during retrieval, but it must be thin enough to allow the cone 130 to slide underneath it. The thicknesses of the slips 120 too must be balanced with how much thickness and radial area is available from the cone 130 and cage 140. Based on the limited amount of cross-section available downhole, the thicknesses of the slips 120, cage 140, and cone 130 can ultimately limit how much load the hydro-style slip mechanism 120 and, hence, the packer 110 can handle.

Although the slip slots 142 are spaced equally around the cage 140, the hydro-style slips 122 are separated by portions 143 of the cage 140 between the slip slots 142 to maintain structural integrity. This can limit the amount of wicker face 124 that can contact with the casing wall.

There are typically three modes of failure common with hydro-style slip mechanisms 110. Loading forces can cause the slip 120 to ride on top of the cone 130 during loading, or the cone 130, due to its reduced thickness, can collapse on the mandrel 14. Additionally, the slips 120 can rip through the slip cage 140 due to its reduced thickness. These failures can occur when the slip mechanism 110 is set in place or during retrieval and typically occur more frequently with increasing loads. As expected, such failures can result in greater retrieval times and greater job expense.

FIGS. 3A-3B show an arrow-style slip mechanism 210 according to the prior art. This mechanism 210 includes arrow-style slips 220, a cone 230, and a cage 240—each of which dispose on the mandrel 14 of a retrievable packer 12 or the like. The arrow-style slips 220 fit around the mandrel 14 and have wickered ends 224 and fitted ends 228 interconnected by necks 222. The fitted ends 228 fit in comparably shaped slots 242 in the cage 240, while the necks 222 fit under a shoulder area 244 on the edge of the cage 240.

The arrow-style slip 220 sets into the casing wall when the cone 230 is mechanically or hydraulically moved closer to the slip cage 240. In particular, the wickered end 224 of the slip 220 includes a ramped edge 227 on its inner side. When the cone 230 is moved toward the cage 240, the cones ramped edge 237 engages the slip's ramped ends 227, pushing the slip's wickered end 224 into the casing wall. When the slip 220 sets, the wickers 226 on the slip's wickered end 224 set into the surrounding casing wall (not shown). Whether the slips 220 are set or not, the cage 240 remains connected to the fitted ends 228 of the arrow-style slip 222 by virtue of these slip slots 242.

Two failure modes are typically observed for this type of slip mechanism 210. First, the slips 220 experience tensile failures or bending in the thinned neck 222. Second, the slip cage 240 can flair out or even rip near the slots 242 and the distal edge or shoulder area 244. These failures can result in greater retrieval times and greater job expenses.

To overcome issues with flaring of the cage 240 and the like, the cage 240 requires portions 243 to be present between the arrow-style slips 220. These portions 243 help give then cage 240 structural integrity around the slip slots 242. Although the slips 220 are spaced equally around the mechanism 210, the need for these portions limits the area of slip wickers 226 that contact with the casing wall.

Moreover, the slip 220 uses the thinned neck 222 that fits under the shoulder area 244 of the cage 240 where a conical spring 260 biases the slip 220 to a retracted position. When the slip 220 is set and under load, the neck 222 of the slip 220 bears load of the tool, as the load is transferred through the back face of the slip 220, through the slip neck 222, and finally through the teeth 226 and into the casing. This loading through the neck 222 can weaken the slip 220 for retrieval.

During retrieval, the shoulder 225 between the neck 222 and fitted end 228 engages against the shoulder area 244 on the cage 240. The thickness of the thinned neck 222 of the slip 220 must be balanced with the width of the slip's wickered end 224. This is because additional width of the wickered end 224 may increase the load on the neck 222. The thickness of the neck 222 must also be configured so that the slip 220 will not tend to bend at the neck 222.

The subject matter of the present disclosure is directed to overcoming, or at least reducing the effects of, one or more of the problems set forth above.

SUMMARY

In one embodiment, a slip mechanism has a cone and a cage disposed on a mandrel of a downhole tool. At least one of the cone and cage are movable relative to the other. The cage has first and second cage ends and defines slip slots that each have an open and closed end. Finger extends in the slots from the closed end to the open end. H-style slips fit into the slip slots and can move between retracted and extended positions relative to the mandrel. The slips have wickers on their entire outer surfaces.

Each slip has opposing sides, a deck, and a toe. The deck connects the opposing sides and fits between the finger and the mandrel. During retrieval, bearing surfaces on the slips engage bearing surfaces of the slots. The slips are retrievable after full loading, retained during run-in and retrieval, and are locked from resetting by locking the cone in place on the mandrel.

In another embodiment, a slip mechanism for a downhole tool has a cage disposed on a mandrel. The cage defines slots, which have first shoulders and a finger. The mechanism also has a cone disposed on the mandrel that has a ramp movable relative to the cage. Slips dispose in these slots, and at least one of the cone and cage is movable relative to the other to engage the slips. Each slip defines a groove in an outward facing surface for the cage's finger. The outward facing surfaces of the slips are covered with wickers. Each slip has a cage end disposed in the slot and has second shoulders engageable with the first shoulders of the cage. The slip also has a free end disposed beyond the cage and has a ramp engageable with the cone. This free end is wider than the open end of the slot, which increases contact area.

The foregoing summary is not intended to summarize each potential embodiment or every aspect of the present disclosure.

DETAILED DESCRIPTION

Figure 1A:
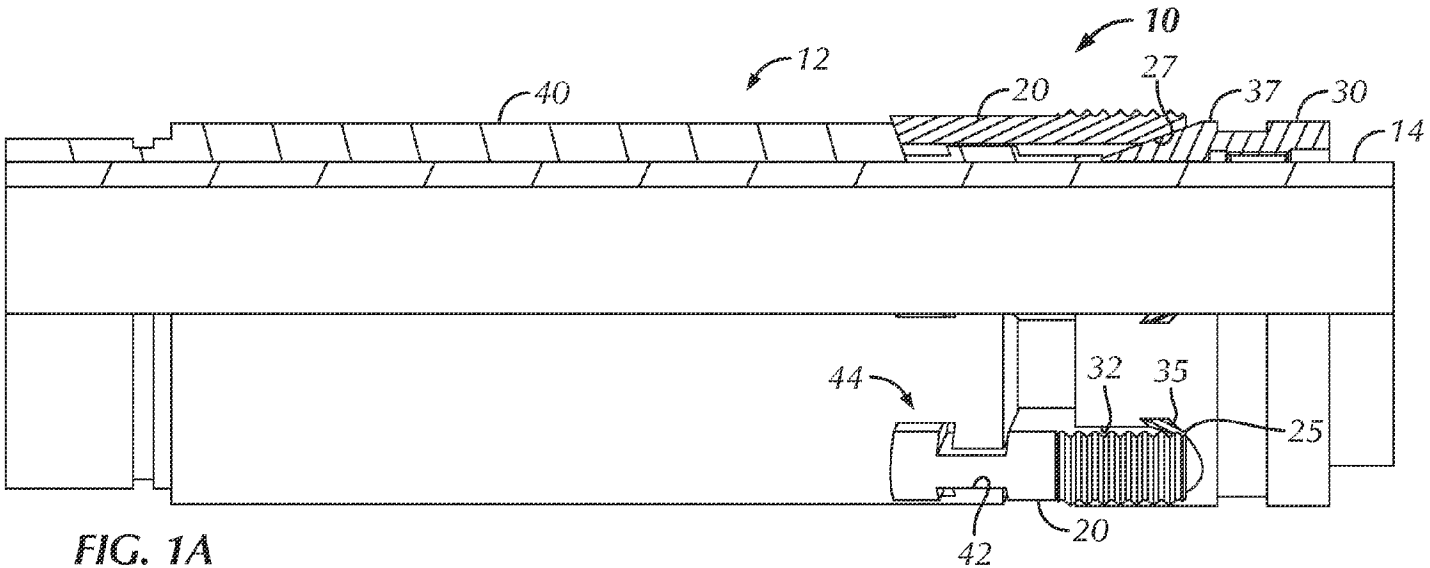
FIG. 1A (Prior Art)
FIG. 1A is a partial cross-section of a downhole tool having a T-style slip mechanism according to the prior art.
Figure 1B:
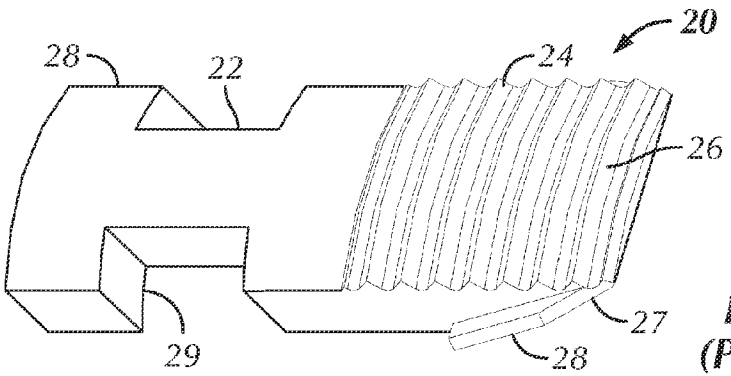
FIG. 1B (Prior Art)
FIG. 1B is a perspective view of the T-style slip of FIG. 1A.
Figure 2A:
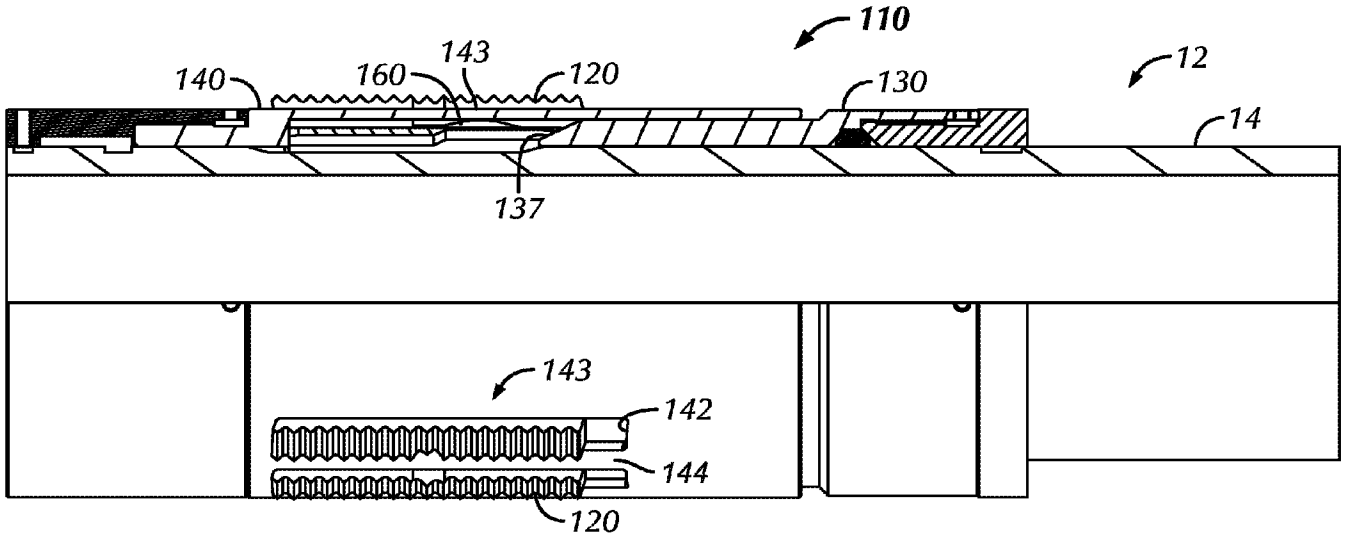
FIG. 2A (Prior Art)
FIG. 2A is a partial cross-section of a downhole tool having a hydro-style slip mechanism according to the prior art.
Figure 2B:
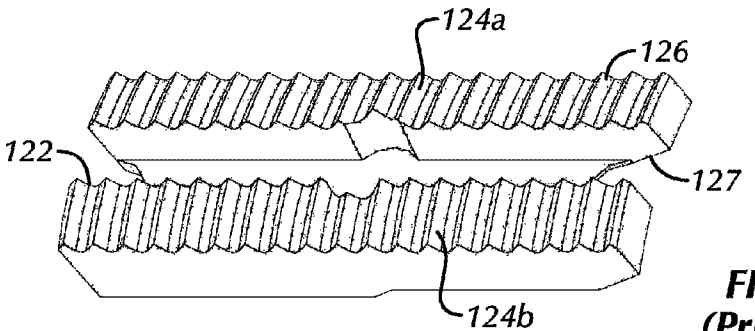
FIG. 2B (Prior Art)
FIG. 2B is a perspective view of the hydro-style slip of FIG. 2A.
Figure 3A:
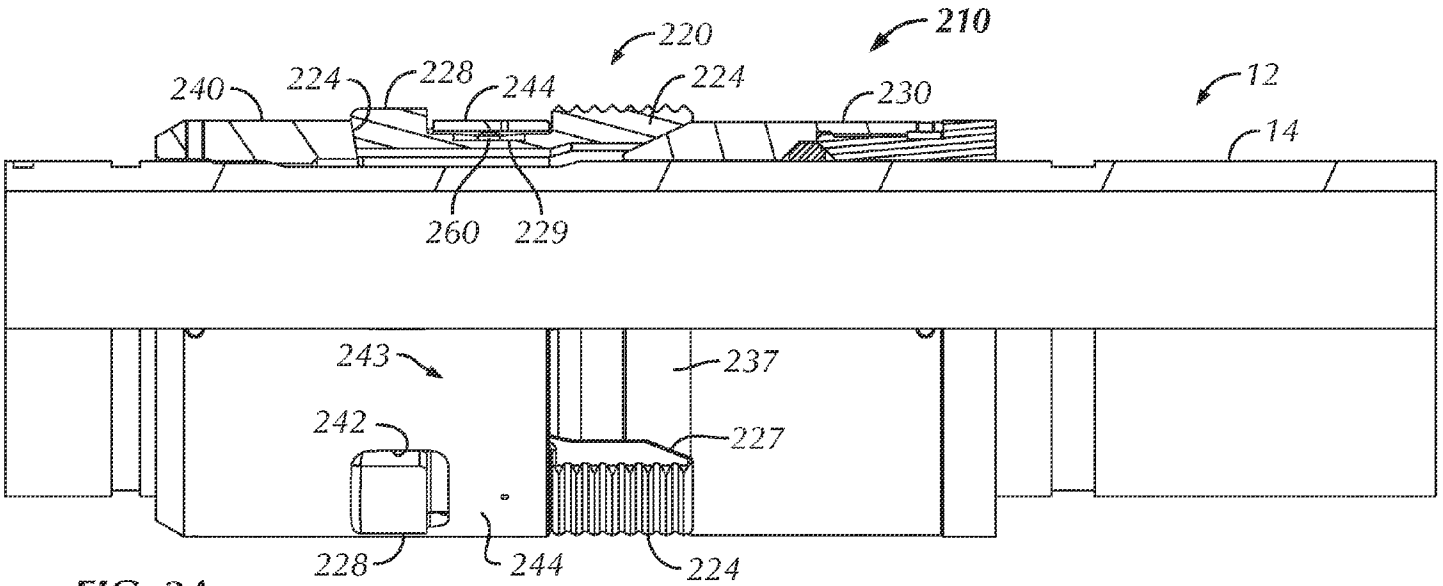
FIG. 3A (Prior Art)
FIG. 3A is a partial cross-section of a downhole tool having an arrow-style slip mechanism according to the prior art.
Figure 3B:
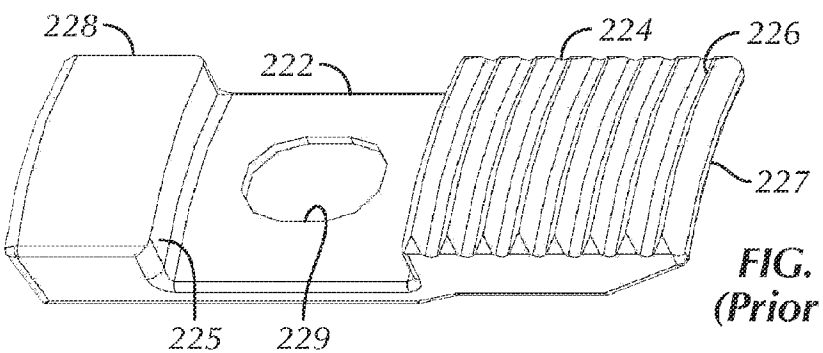
FIG. 3B (Prior Art)
FIG. 3B is a perspective view of the arrow-style slip of FIG. 3A.
Figure 4A:
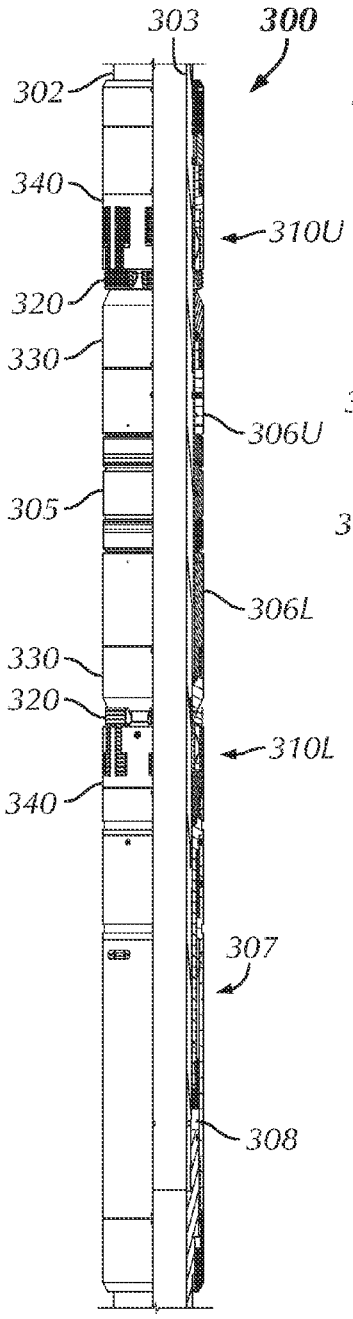
FIG. 4A is an elevational view of a downhole tool having H-style slip mechanisms according to the present disclosure in a run-in condition.
Figure 4B:
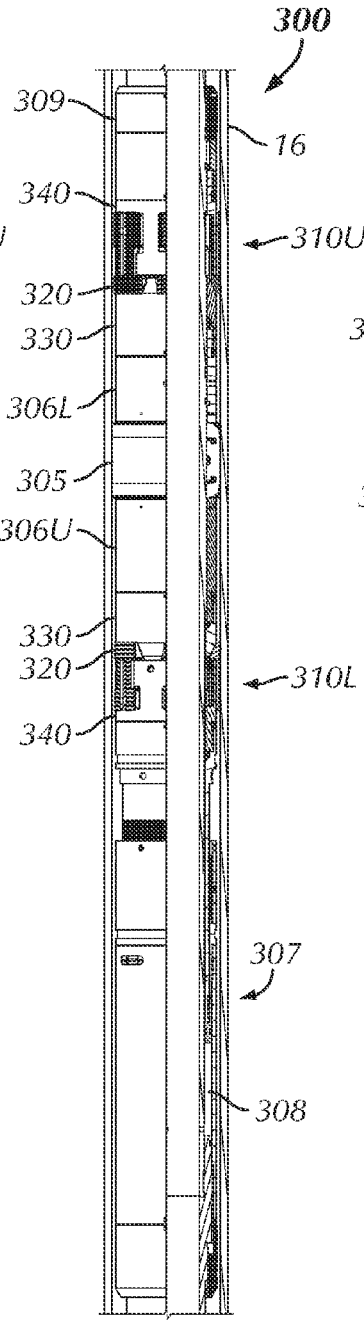
FIG. 4B is an elevational view of the downhole tool having the H-style slip mechanisms in a set condition.
Figure 4C:
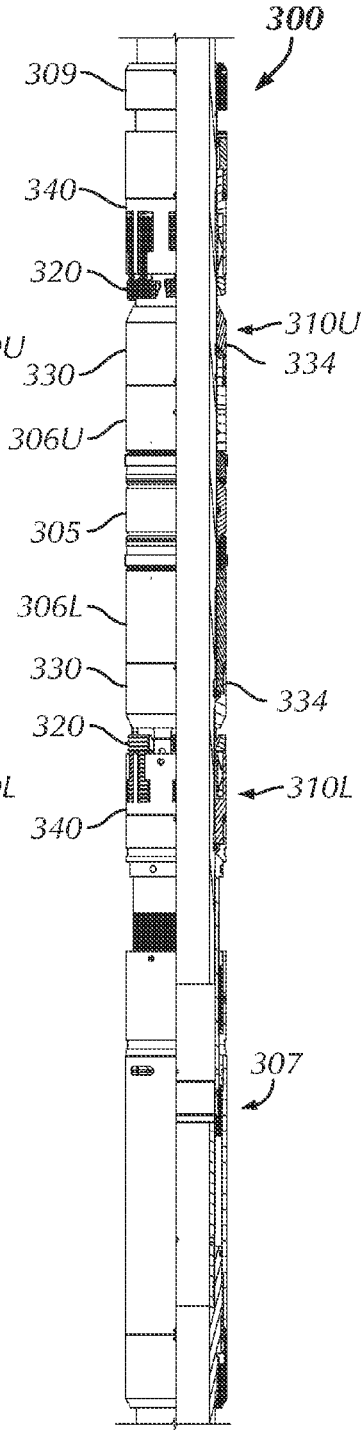
FIG. 4C is an elevational view of the downhole tool having the H-style slip mechanisms in a retrieval condition.
Figure 5A:
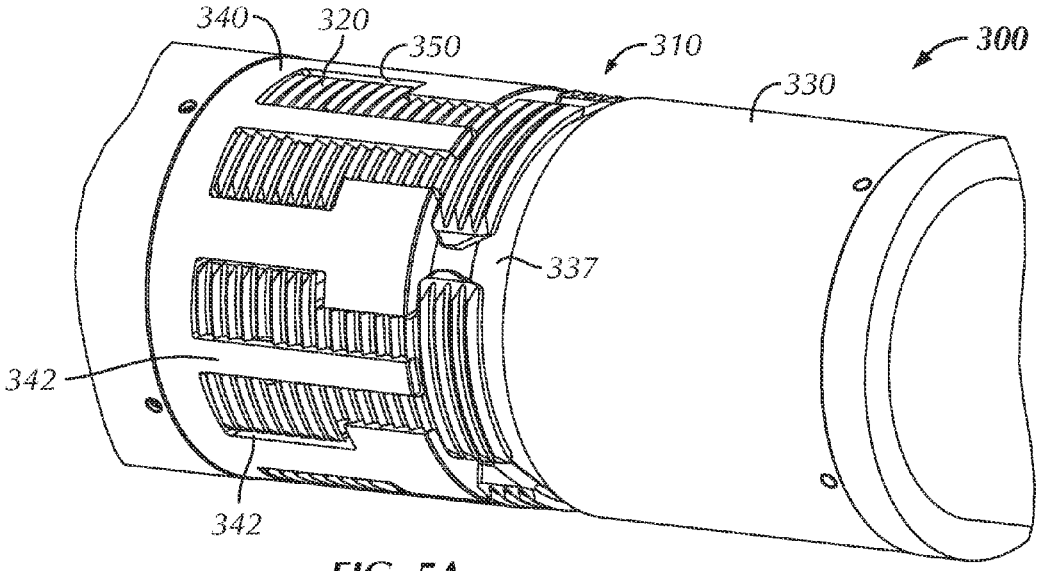
FIG. 5A is a perspective view of the H-style slip mechanism on the downhole tool.
Figure 5B:
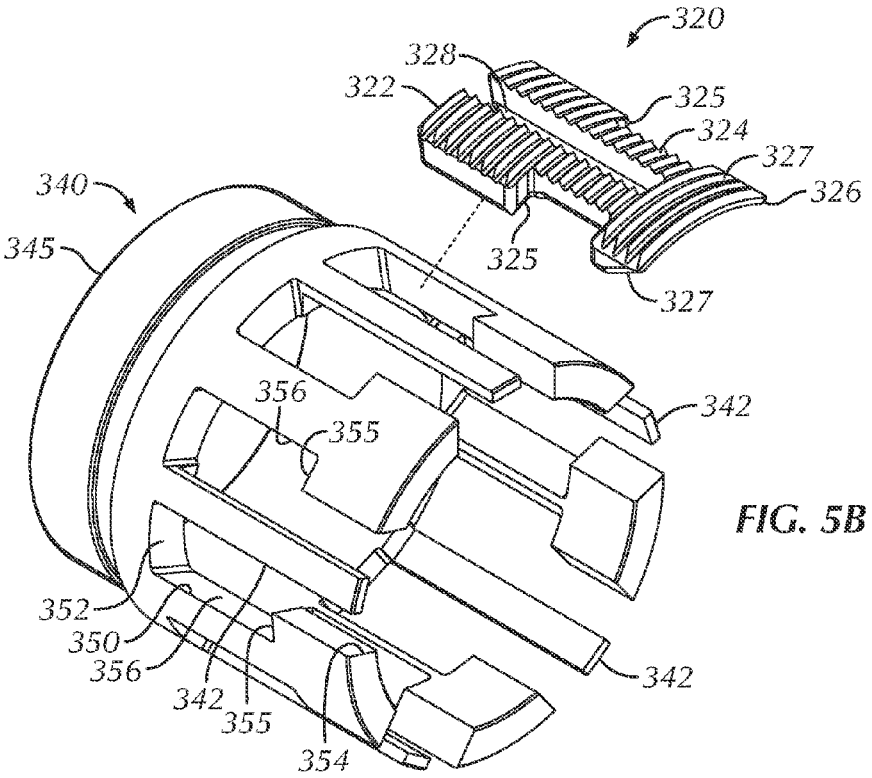
FIG. 5B is a perspective view of the cage and slip for the H-style slip mechanism.
Figure 6B:
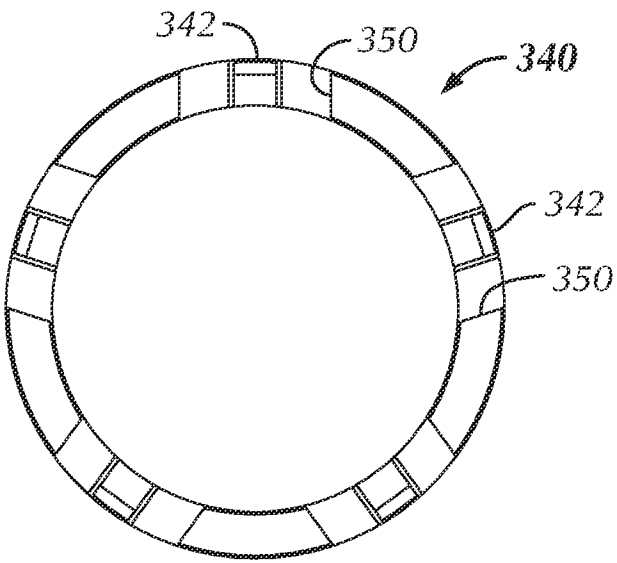
FIG. 6B is a top view of the cage mechanism.
Figure 6A:
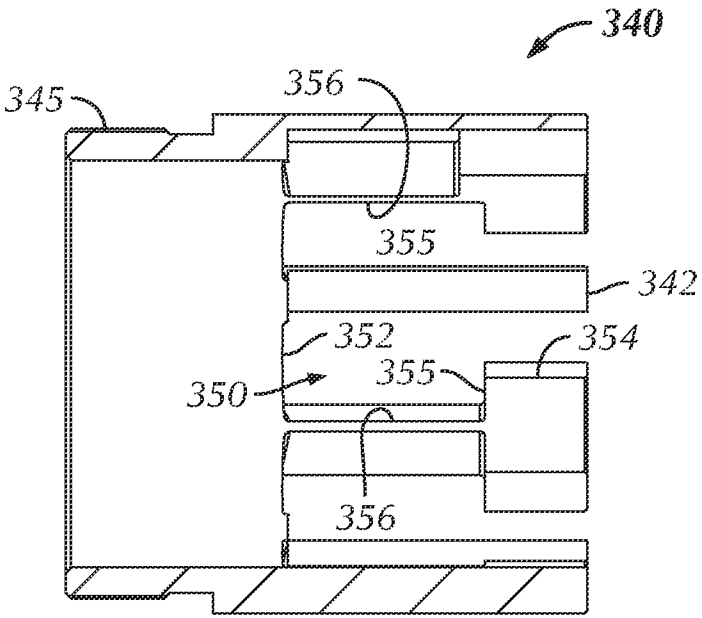
FIG. 6A is a cross-section side view of the cage mechanism.

A slip mechanism 310 shown in FIGS. 4A through 5B can be used for a retrievable downhole tool 300, such as a retrievable packer. As best shown in FIGS. 5A-5B, the slip mechanism 310 has H-style slips 320, a cone 330, and a cage 340—each of which dispose on the tool's mandrel 302. The cage 340 has slip slots 350 and retaining fingers 342 spaced equally around the cage 340. The H-style slips 320 dispose in these slip slots 350 around the circumference of the tool 300. In the present example, the mechanism 310 has five such slips 320, but more or less could be used depending on the implementation.

Depending on the position of the cone 330 relative to the cage 340, the H-style slips 320 can be moved between retracted and extended positions on the mandrel 302 and can either engage or disengage a surrounding casing wall (not shown). As shown in FIG. 4A, for example, the tool 300 can be a packer having a compressible packing element 305 disposed between gauge rings 306U/306L. Uphole and downhole slip mechanisms 310U/310L dispose on either side of the packing element 305 and gauge rings 306U/306L. An activation mechanism 307, such as a hydraulic or mechanical mechanism known in the art, disposes on the downhole end of the tool 300 next to the lower slip mechanism 310L. When activated, the activation mechanism 307 can compress the packing element 305 and can set the slip mechanisms 310U/310L by moving the cones 330 toward the cages 340 or vice versa.

During a run-in condition shown in FIG. 4A, for example, the activation mechanism 307 (shown here as a hydraulic piston) remains unset so that the slips 320 remain retracted against the mandrel 302 and the packing element 305 remains uncompressed. When run downhole in the casing 16 to a desired location, fluid pressure pumped down the mandrel's bore 303 enters a chamber 308 in the activation mechanism 307. The resulting piston effect pushes the lower cage 340 of the downhole mechanism 310L toward the lower cone 330 to set the lower slips 320.

At the same time, the lower cone 330 pushes the lower gauge ring 306L against the packing element 305 to compress it against the upper gauge ring 306U. On the other end of the tool 300, a collar 309 affixed to the mandrel 302 holds the upper cage 340 in place while the upper gauge ring 306U pushes the upper cone 330 toward the cage 340 to set the upper slips 320.

For retrieval, the mandrel 302 is cut near the activation mechanism 307 as shown in FIG. 4C. This can be accomplished using a motorized cutting tool, chemical technique, radial cutting torch, or the like. Upward pulling on the mandrel 302 then moves the cones 330 and cages 340 apart, relaxes the compressed packing element 305 between the gauge rings 306U/306L, and unsets the slips 320. Locking dogs 334, as described in more detail later, keep the cones 330 from moving back towards the cages 340, which helps prevent resetting of the slips 320 during retrieval.

With an understanding of the H-style slip mechanism 310 and a downhole tool 300 on which it can be used, discussion now turns to additional details of the components of the H-style slip mechanism 310 and its operation.

Further details of the cage 340 are provided in FIGS. 5A-5B and 6A-6B. At one end, the cage 340 has a solid band 345 for connecting the cage 340 to other elements of the downhole tool 300 (See FIG. 5A). At the other end, the cage 340 has the slip slots 350. Each of these slip slots 350 has a closed end 352 toward the cage's banded end 345 and has an open end 354 toward the cage's distal edge. As shown, the fingers 342 in each slot 350 attach from the closed end 352 and extend to the open end 354 of the slip slot 350.

Further details of the slips 320 are provided in FIGS. 5A-5B and 7A-7E. Each slip 320 has a cage end 322 at a proximal portion thereof. When the slip 320 sits in the cage 340 (See FIG. 5A), this cage end 322 fits into the complementarily shaped cage slot 350. Each cage end 322 has opposing sides 323 separated by a deck 328 that accommodates the cage's finger 342 and retains an inset spring (not shown) as described below. Each of these opposing sides 323 on the slip's cage end 322 defines a first bearing surface or shoulder 325 facing toward the slip's distal end 326. When the slip 320 positions in the slip slot 350 (See FIG. 5A), opposing inner walls 356 of the slip slot 350 have second bearing surfaces or shoulders 355 that axially retain the first shoulders of the slips 320. Thus, the cage slot's shoulders 355 face the slot's closed end 352 and can engage the slip's shoulders 325 during retrieval.

As also shown, the slip 320 has a free end or toe 326 at a distal portion thereof. This free end 326 extends outside the slot's open end 354 and beyond the edge of the cage 340 when the slip 320 sits in the cage 340 (See FIG. 5A). This free end 326 has a ramped edge 327 for engagement with a ramped edge 337 on the cone 330. The slip's free end 326, however, is at least as wide as the cage end 322. Thus, the slip 320 forms a stem or neck 324 between the cage and free ends 322 and 326. Moreover, the slip 320 has wickers 329 disposed on its outward facing surface covering the cage end 322, free end 326, and the stem 324 interconnecting them. Thus, the wickers 329 cover the entire outer surface of the slips 320.

Figure 8A:
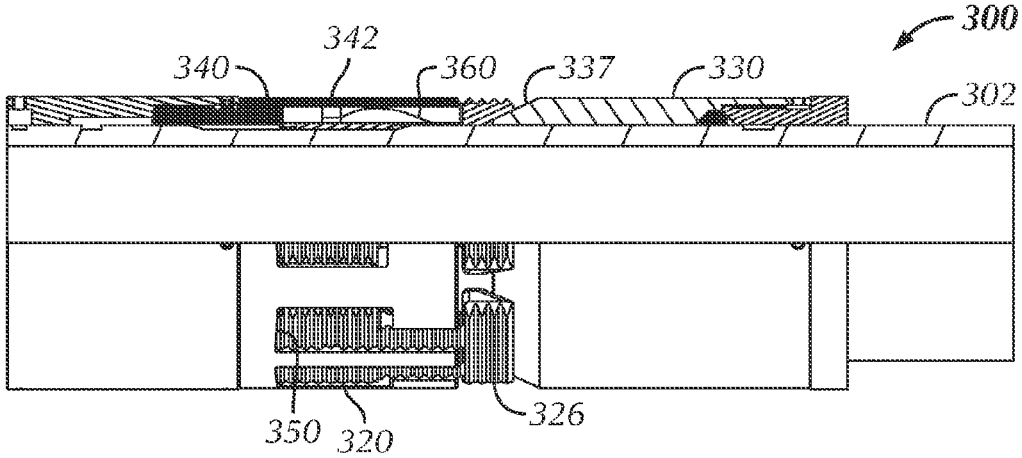
FIG. 8A is a partial cross-section of the downhole tool having the H-style slip mechanism shown in an unset position.

Operation of the slip mechanism 310 is now described with reference to FIGS. 8A-8C. Initially as shown in FIG. 8A, the H-style slips 320 remain in an unset position for run in downhole. Being unset, the slip 320 remains retracted against the mandrel 302 by the spring 360 so the wickers 329 do not set into the casing wall (not shown). Once the downhole tool 300 has been positioned in a desired location, the activation mechanism (307; FIG. 4A) on the tool 300 moves the cone 330 toward the cage 340 and the slips 320 or vice versa, depending on the configuration of the tool. (As noted previously, the cone 330 can be moved towards the cage 340 when disposed on the tool's uphole section, while the cage 340 can be moved towards the cone 320 when disposed on the tool's downhole section.)

Figure 8B:
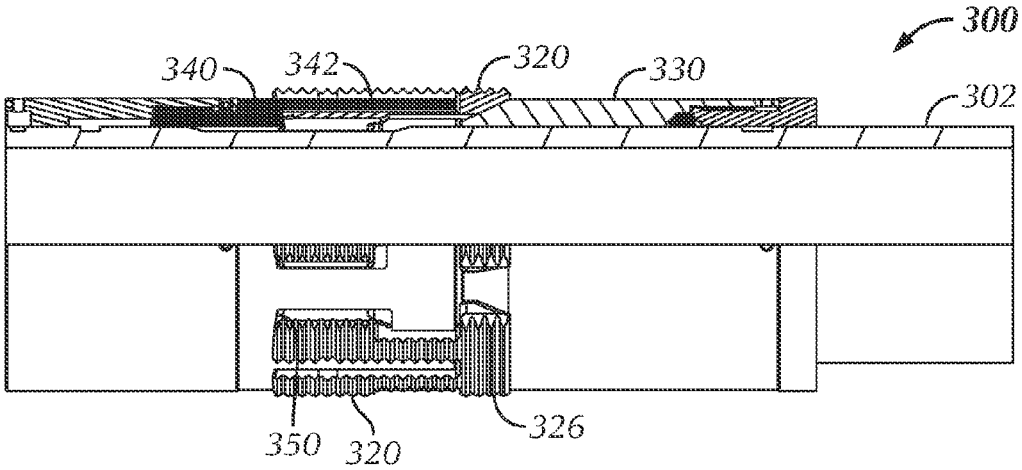
FIG. 8B is a partial cross-section of the downhole tool having the H-style slip mechanism shown in the set position.

As shown in FIG. 8B, the cone 330 moved closer to the slip cage 340 pushes the H-style style slip 320 to set it into the surrounding casing wall (not shown). As noted previously, the free end 326 of the slip 320 includes the ramped edge 327 on its mandrel facing side. When the cone 330 is moved toward the cage 340, the cone's ramped edge 337 engages the slip's ramped edge 327, which pushes the slip 320. (The closed end 352 of the cage's slot 350 as well as the cage end 322 of the slip 320 are also ramped slightly to facilitate movement of the slip 320 in the slot 350.) When the slip 320 extends away from the mandrel 302, the slip's wickers 329 can then set into the surrounding casing wall.

At some point during operation, it may be desirable to disengage or unset the slip mechanism 310 so the downhole tool 300 can be retrieved. FIG. 8C shows the H-style slip 320 being unset after retrieval. The cage 340, when part of the uphole mechanism 310U of the tool 300 (See FIG. 4C), pulls the slips 320 from the casing during retrieval. The uphole cone 330 does not move away from the slips 320 until after the slips 320 are pulled from the casing. However, when part of the downhole mechanism 310L of the tool 300 (See FIG. 4C), the cone 330 does pull away from the downhole slips 320, allowing the slips 320 to drop from the casing.

Figure 8C:
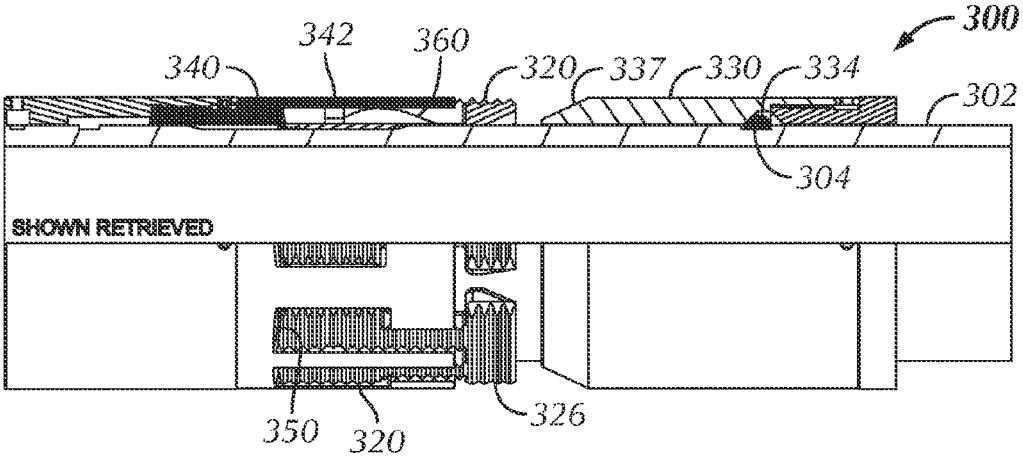
FIG. 8C is a partial cross-section of the downhole tool having the H-style slip mechanism shown the retrieval position.

As shown here in FIG. 8C, the cone 330 locks into place in a retracted position using dogs 334 that fit into a groove 304 around the mandrel 302. In this way, the cone 330 can be held in place on the mandrel 302 as the downhole tool 300 is retrieved. This prevents the cone 330 from resetting the slips 320.

With the cone 330 moved, the slips 320 remain unsupported, and the spring 360 seeks to retract the slips 320 toward the mandrel. Yet, the slips 320 may still be wedged and set in the casing wall. Axial movements of the tool 300 during retrieval procedures then disengage the slip's wickers 329 from the casing wall. All the while, the slips 320 remain held by the slots 350 in the cage 340.

The H-style slip mechanism 310 has several benefits over existing slip mechanism for retrievable tools, such as packers. In one benefit, the thickness of the mechanism's cone 330 is not governed by the thickness of the cage 340 or vice versa, and the cone 340 can be locked into place during the retrieval process (but after the slips 320 have been pulled from the casing) to prevent the slips 320 from resetting. In another benefit, the H-style slip 320 has a larger cross-section through its retrieval load path, which gives the slip 320 a greater load capability than conventional slips. Additionally, the slip 320 has a wide free end 326 that increases the contact area and helps distribute load for the slip 320. Further, the H-style slip 320 has an outer surface covered with wickers 329, which again increases contact area and helps distribute load. Finally, the H-style slip 320 uses the spring 360 to help retract the slip 320 and maintain this position during run-in and retrieval. The following paragraphs contain further details of these benefits.

In one benefit noted above, the thickness of the mechanism's cone 330 is not governed by the thickness of the cage 340 or vice versa. Notably, the H-style slip mechanism 310 does not require the cone 330 to fit under the slip cage 340 to push the slips 320 outward from the mandrel 302. As noted in the Background of the present disclosure, prior art slip mechanisms may require a cone to fit under a cage, which limits the thicknesses that both of these components can have. The present mechanism 310, however, avoids the need to have the cone 330 fit under the cage 340 so the mechanism 310 does not have such a limitation on thicknesses. In the end, the mechanism 310 can thereby bear greater loads during setting and retrieval due to the greater cage 340 and cone 330 thicknesses that are possible. In fact, the cage 340 can be as thick as the cone 330.

Figure 7D:
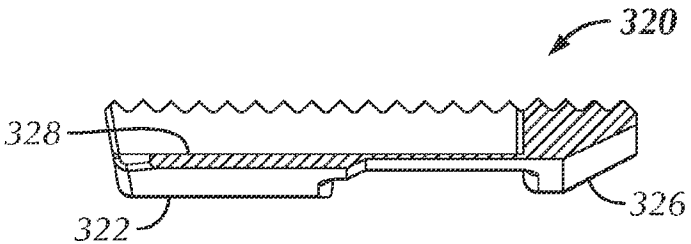
FIG. 7D is another side view of the H-style slip in cross-section along line D-D.
Figure 7E:
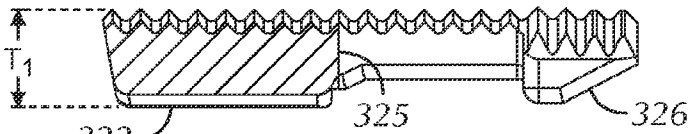
FIG. 7E is another side view of the H-style slip in cross-section along line E-E.
Figure 7C:
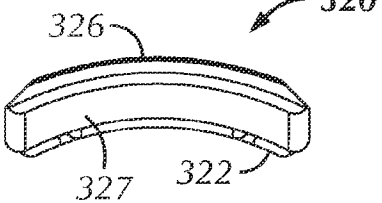
FIG. 7C is a side view of the H-style slip.
Figure 7A:
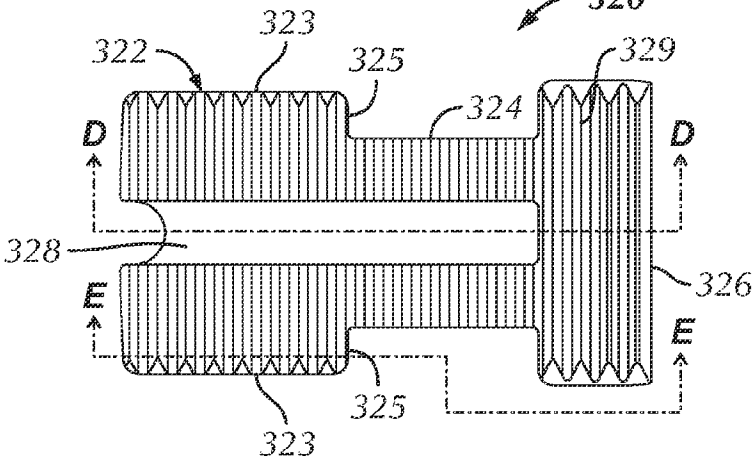
FIG. 7A is a top view of the H-style slip.

In another benefit noted previous, the H-style slip 320 has a larger cross-section through its retrieval load path, which gives the H-style slip 320 a greater load capability than conventional slips. As best shown in FIG. 7E, the cage end 322 of the slip 320 has a cross-sectional thickness $T_1$ for the load-bearing path of the slip's bearing shoulders 325. During retrieval, the cage's shoulders (355) engage the slip's shoulders 325, resulting in forces being applied to both the cage (340) and the slip 320. As can be seen, the cross-sectional thickness of the slip 320 at this shoulder 325 can be as great as or equal to the thickness of the cage's shoulders 355. This helps to evenly distribute load during retrieval.

Given the increased cross-sectional thickness $T_1$ at the slip's load bearing path, the load rating of the H-style slips 320 can be higher than currently available in the art. In fact, based on testing, the slips 320 may be retrieved after a maximum load of over 300,000 lbs (tension and boost loads), and it may be possible to retrieve the slips 320 without failure above 100,000 lbs or even 150,000 lbs, which is considerably higher than the rating of prior art slips.

Along the same lines, the overall thickness of the H-style slip 320 can remain relatively consistent along the length of the slip 320 from the cage end 322 to the free end 326. As best shown in FIG. 7E, for example, the thickness along the length of the slip 320 through which loads apply can remain relatively even. Because the H-style slips 320 does not need to be thinned at some point along its axial length to accommodate a portion of the cage 340 or the like, the slip 320 exhibits greater strength along its length.

Only laterally does the thickness of the slip 320 change significantly due to the deck 328 used to accommodate the retaining finger (342) on the cage (340). This lateral change in thickness does not experience the axial loads during setting and retrieval so it is less problematic. In the end, both the cage 340 and the slips 320 are more uniformly thick along their lengths. As a result, the slip 320 is less prone to tensile failure, and the cage 340 is less prone to flaring or warping.

Figure 7B:
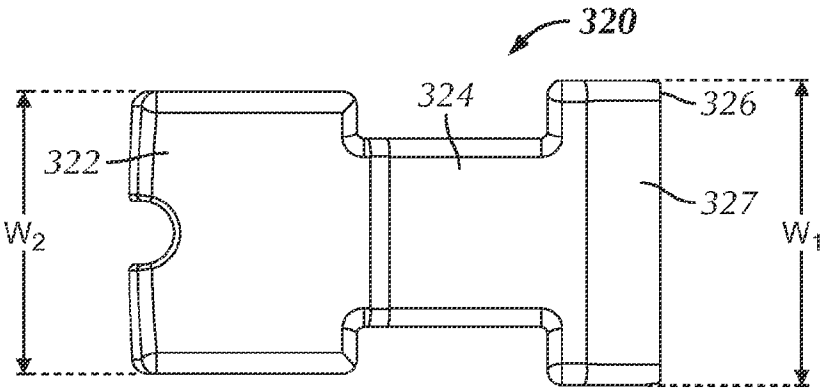
FIG. 7B is a bottom view of the H-style slip.

As noted previously, the slip's wide free end 326 increases the contact area and helps distribute load for the slip 320. As shown in FIG. 4, contact gaps 370 are present between the slips' free ends 326 around the mechanism 310. Due to the widened free end 326 extending beyond the cage 340, however, these gaps 370 can be reduced in the H-style slip mechanism 310 compared to conventional mechanisms in the art. This allows for increased radial gripping coverage of the H-style slip mechanism 310. In fact, the free end 326 as shown in FIG. 7B can have a width $W_1$ that is at least as wide as or even wider than the width $W_2$ of the cage end 322.

As also noted previously, the H-style slips 320 have their outer surfaces covered with wickers 329, which increases contact area and helps distribute load. This is best shown in FIG. 4. The multiple H-style slip 320*s* have their wickers 329 covering the entire outside surface area of the cage end 322, interconnecting stem 324, and free end 326 of the slip 320. As noted previously, prior art slips either lack entire wickered surfaces or have limited surface area due to mechanical limitations of such mechanisms. The additional wickered surface area of the H-style slips 320 provide the disclosed slip mechanism 310 with increased radial gripping coverage.

Finally, the springs 360 (See FIG. 8A) help retract the slips 320 and maintain their position during run-in and retrieval. As shown, the spring 360 sits between the H-style slip's deck 328 and the cage's finger 342. This spring 360, which can be a leaf spring, pushes the slip 320 toward a retracted position toward the mandrel 302. During run-in and retrieval, the spring 360 helps keep the slip 320 un-set when the cone 330 is moved away from the cage 340.

As a related point, the cone 340 can be locked into place during retrieval to prevent the slip 320 from resetting. The springs 360 hold the H-style slips 320 retracted so the cone 340 does not need to mechanically hold the slips 320 retracted at its ends, such as required by some prior art slips. Being free from having to hold the slips 320, the cone 330 can be locked into a disengaged position as shown in FIG. 8C, which helps prevent the slips 320 from resetting during retrieval. In the end, forces on the slips 320 can be reduced during retrieval.

The foregoing description of preferred and other embodiments is not intended to limit or restrict the scope or applicability of the inventive concepts conceived of by the Applicants. Although the disclosed slip mechanism has been described for use with a packer, the slip mechanism can be used with any suitable downhole tool on which slips can be used, including, for example, bridge plugs, downhole valves, liner hangers, holddown subs, etc. Additionally, although described as being activated by a hydraulic mechanism, the slip mechanism can be activated using hydraulic, mechanical, or other method known and used in the art. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole tool slip mechanism, comprising:

a cone disposed on a downhole tool;

a cage disposed on the downhole tool and defining at least one slip slot, the at least one slip slot having a closed end, an open end, and opposing inner walls extending from the closed end to the open end, at least one of the cone and cage being movable relative to the other;

at least one finger disposed on the cage and extending from the closed end to the open end of the at least one slip slot, the at least one finger having a first proximal end attached to the closed end and having a first distal end freely disposed toward the open end; and at least one slip disposed in the at least one slip slot and being movable between retracted and extended positions relative to the downhole tool, the at least one slip having a second proximal end and a second distal end, the at least one slip having opposing sides toward the second proximal end, a deck toward the second proximal end, and a toe toward the second distal end, the deck connecting the opposing sides and disposed between the at least one finger and the downhole tool, the deck being retained radially by the at least one finger, the opposing sides exposed in the at least one slot between the opposing inner walls and the at least one finger, the toe disposed at least radially unretained beyond the open end of the at least one slot, the opposing sides each defining a first bearing surface retained axially by the opposing inner walls of the at least one slip slot.

2. The mechanism of claim 1, wherein the cone has a first ramped surface, and wherein the toe has a second ramped surface engageable with the first ramped surface.

3. The mechanism of claim 1, wherein the cone has a first thickness at least as great as or equal to a second thickness of the cage.

4. The mechanism of claim 1, wherein the opposing sides and the toe of the at least one slip each comprise an outer surface with wickers disposed thereon.

5. The mechanism of claim 1, wherein each of the opposing inner walls has a second bearing surface facing the closed end and engageable with the first bearing surfaces.

6. The mechanism of claim 5, wherein the first bearing surfaces define a first thickness, and wherein the second bearing surfaces define a second thickness at least as great as or equal to the first thickness.

7. The mechanism of claim 5, wherein each of the first bearing surfaces defines a first width, and wherein each of the second bearing surfaces defines a second width at least as great as or equal to the first width.

8. The mechanism of claim 1, further comprising a spring disposed between the at least one finger and the deck and biasing the at least one slip to the retracted position.

9. The mechanism of claim 8, wherein the spring comprises a leaf spring.

10. The mechanism of claim 1, wherein the cone is lockable relative to the cage.

11. The mechanism of claim 1, wherein the slip mechanism is retrievable.

12. The mechanism of claim 1, wherein the toe has a first width at least as great as or greater than a second width of the closed end of the at least one slip slot.

13. The mechanism of claim 1, wherein the toe has a first width greater than a second width defined by the open end of the at least one slip slot.

14. The mechanism of claim 1, wherein the cage defines a plurality of the at least one slip slots defined about the cage, and wherein the mechanism comprises a plurality of the at least one slips disposed in the slip slots.

15. A downhole tool, comprising:

a mandrel;

a cone disposed on the mandrel;

a cage disposed on the mandrel and defining at least one slip slot, the at least one slip slot having a closed end, an open end, and opposing inner walls extending from the closed end to the open end, at least one of the cone and cage being movable relative to the other;

at least one finger disposed on the cage and extending from the closed end to the open end of the at least one slip slot, the at least one finger having a first proximal end attached to the closed end and having a first distal end freely disposed toward the open end; and at least one slip disposed in the at least one slip slot and being movable between retracted and extended positions relative to the mandrel, the at least one slip having a second proximal end and a second distal end, the at least one slip having opposing sides toward the second proximal end, a deck toward the second proximal end, and a toe toward the second distal end, the deck connecting the opposing sides and disposed between the at least one finger and the mandrel, the deck being retained radially by the at least one finger, the opposing sides exposed in the at least one slot between the opposing inner walls and the at least one finger, the toe disposed at least radially unretained beyond the open end of the at least one slot, the opposing sides each defining a first bearing surface retained axially by the opposing inner walls of the at least one slip slot.

16. The downhole tool of claim 15, further comprising:

a compressible packing element disposed on the mandrel; and an activation mechanism compressing the packing element and moving either the cone or the cage relative to the other.

17. The downhole tool of claim 15, further comprising another slip mechanism having a second cone, a second cage, and at least one second slip disposed on the mandrel in opposing relation to the cone, the cage, and the at least one slip.

18. A downhole tool slip mechanism, comprising:

a cage disposed on a mandrel and defining at least one slot, the at least one slot having first shoulders and a finger, the finger extending from a closed proximal end of the at least one slot to an open distal end of the at least one slot;

a cone disposed on the mandrel, at least one of the cone and cage being movable relative to the other;

at least one slip disposed in the at least one slot and having— a cage end disposed in the closed proximal end of the at least one slot and having second shoulders engageable with the first shoulders, a free end disposed beyond the open distal end of the cage and being engageable with the cone, a stem disposed in the at least one slot and connecting the cage end to the free end, an outward facing surface extending across the cage end, the stem, and the free end, and a groove defined in the outward facing surface and extending at least from the cage end to the stem, wherein the first shoulders of the cage and the second shoulders of the cage end axially retain the at least one slip, and wherein the finger of the cage and the groove of the at least one slip radially retain the at least one slip.

19. A downhole tool, comprising:

a mandrel;

a cage disposed on the mandrel and defining at least one slot, the at least one slot having first shoulders and a finger, the finger extending from a closed proximal end of the at least one slot to an open distal end of the at least one slot;

a cone disposed on the mandrel, at least one of the cone and cage being movable relative to the other;

at least one slip disposed in the at least one slot and having— a cage end disposed in the closed proximal end of the at least one slot and having second shoulders engageable with the first shoulders, a free end disposed unretained beyond the open distal end of the cage and being engageable with the cone, a stem disposed in the at least one slot and connecting the cage end to the free end, an outward facing surface extending across the cage end, the stem, and the free end, and a groove defined in the outward facing surface and extending at least from the cage end to the stem, wherein the first shoulders of the cage and the second shoulders of the cage end axially retain the at least one slip, and wherein the finger of the cage and the groove of the at least one slip radially retain the at least one slip.

20. The downhole tool of claim 19, further comprising:

a compressible packing element disposed on the mandrel; and an activation mechanism compressing the packing element and moving either the cone or the cage relative to the other.

21. The downhole tool of claim 19, further comprising another slip mechanism having a second cone, a second cage, and at least one second slip disposed on the mandrel in opposing relation to the cone, the cage, and the at least one slip.

* * * * *